US006695800B1

(12) United States Patent
Gary et al.

(10) Patent No.: US 6,695,800 B1
(45) Date of Patent: Feb. 24, 2004

(54) HAND TREATMENT DEVICE

(75) Inventors: Barbara Gary, Fountaintown, IN (US); Nancy Mullins, Indianapolis, IN (US); Bernard Strong, Tarzana, CA (US)

(73) Assignee: Mulgary Enterprises, LLC, Fountaintown, IN (US)

( * ) Notice: Subject to any disclaimer, the term of this patent is extended or adjusted under 35 U.S.C. 154(b) by 159 days.

(21) Appl. No.: 09/751,239

(22) Filed: Dec. 29, 2000

Related U.S. Application Data

(60) Provisional application No. 60/174,946, filed on Jan. 7, 2000.

(51) Int. Cl.[7] ..... A61H 19/00; A45D 29/18

(52) U.S. Cl. ..... 601/154; 132/74.5

(58) Field of Search ..... 601/27–28, 154–160, 601/162, 166, 55, 49, 22, 15, 17; 132/74.5; 604/152

(56) References Cited

U.S. PATENT DOCUMENTS 3,881,471 A 5/1975 Grube
4,020,856 A 5/1977 Masterson
4,307,738 A 12/1981 Barns
4,441,487 A 4/1984 Daugherty et al.
4,446,855 A 5/1984 Friedson
4,513,735 A 4/1985 Friedson et al.
4,513,736 A 4/1985 Thurber
5,167,225 A 12/1992 Cheng-I
5,729,841 A 3/1998 Chan
5,785,668 A 7/1998 Shimizu
6,289,900 B1 9/2001 Kay ..... 132/74.5
6,309,366 B1 * 10/2001 Maxwell ..... 601/166

* cited by examiner

*Primary Examiner*—Stephen R. Crow
(74) *Attorney, Agent, or Firm*—Woodard, Emhardt, Moriarty, McNett & Henry LLP

(57) ABSTRACT

A device for treating a user's hand with a treatment fluid is provided. The device includes a housing that defines a basin for holding the treatment fluid. The device includes a hand rest portion for supporting the user's hand with the fingers in the basin. The treatment fluid is circulated within the basin to provide therapy to the user's hand. The treatment device may also provide a vibratory massage and heat therapy to the user's hand.

29 Claims, 12 Drawing Sheets

HAND TREATMENT DEVICE

CROSS-REFERENCE TO RELATED APPLICATIONS

The present application claims the benefit of the filing date of Provisional Application No. 60/174,946 filed on Jan. 7, 2000.

BACKGROUND OF THE INVENTION

The present invention relates generally to a therapeutic device, and more particularly to a device for providing therapy to the hand and lower arm.

There are many reasons why one would need therapy or treatment for the hand or lower arm. One reason is related to hygiene. For example, it is desirable to soften the cuticles so that they may be removed or pushed back. It is also desirable to remove dirt and grime from under the fingernails and from the fingertips and cuticles. This type of treatment is often received prior to receiving a manicure. One technique for treating the fingers in this manner involves soaking the fingers in hot soapy water, oil, or some type of treatment fluid having a medicinal affect. Various lotions or vitamins may also be added to further enhance treatment. The treatment fluid softens the cuticles and helps to loosen dirt and grime under the fingernails.

Another reason for treating the hand is related to relieving sore muscles, joints and tendons. One technique for providing such relief is to massage the muscles, tendons, and joints of the hand. Massage therapy to these areas induces relaxation and provides other benefits, such as stimulating the muscles and joints and increasing circulation of blood therethrough. Hydrotherapy is another technique for treating sore muscles.

There have been various devices developed for treating the hand. For example, U.S. Pat. No. 4,020,856 to Masterson describes a fingernail and hand cleaning device that applies pulsating jets of liquid to the ends of the fingers of a users hand while the hand is positioned within the device on a hand rest. Additional pulsating jets of liquid are applied to other areas of the user's hand.

U.S. Pat. No. 4,307,738 to Barns describes a heated bath device for preparing fingernails for manicuring. More particularly, the Barns device heats a nail-treating bath solution and circulates it by vibration. Another type of hand treatment device is described in U.S. Pat. No. 4,441,487 to Daugherty et al. The Daugherty device includes a contoured, hollow handrest which supports the hand with the fingers in outstreched separate positions, and which is centered in a shallow container including a semi-annular barrier of oil-soaked sponge against which the fingernails and cuticles rest, and additionally includes means for heating the oil above room temperature. The handrest in Daugherty is constructed to include a vibrator adjacent to its inner surface.

While the above referenced patents are a step in the right direction in providing a hand treatment device, there remains room for additional improvements. For example, there remains a need for a device that adequately provides hydrotherapy to the hand during the treatment process. There also remains a need for a treatment device capable of providing various types of treatments to the hand to provide the most benefit to the user in the least amount of time. The present invention is directed toward meeting the above needs, among others.

SUMMARY OF THE INVENTIONS

The present inventions are directed towards hand treatment devices and methods for using the devices which include a treatment fluid for treating at least a portion of a user's hand. The method and device may assist in the preparation of cuticles for further treatment and/or may be used to treat the hand so as to sooth and relax the user.

In one embodiment of the present inventions, the hand treatment device provides a continuous flow of treatment fluid against the hand portion to be treated. The device includes a housing with a basin and a treatment fluid in the basin. A hand rest is positioned within the housing adjacent the basin. The treatment fluid is circulated in the basin to provide therapy to the submerged portion of the hand.

In another embodiment of the present inventions, the device includes a housing with a basin and a treatment fluid in the basin. A hand rest is positioned within the housing adjacent the basin. The device housing includes at least one opening in communication with the basin. An air compressor in the housing is coupled to a power source and is connected with the at least one opening. The air compressor supplies air to the basin through the at least one opening to aerate and/or circulate the treatment fluid in the basin around the submerged portion of the hand.

In another embodiment of the present inventions, a plurality of nodes extend above the surface of the hand rest. The nodes support at least a portion of the hand above the surface of the hand rest. Optionally, a source of vibration may be applied to the handrest, wherein the nodes may be used to transmit the vibratory force to the hand to provide massage therapy.

In another embodiment of the present inventions, the surface of the hand rest may, optionally, include a palm support portion and/or a wrist support portion. In a further embodiment, the housing can be sized and shaped to accommodate the hand and lower arm of the user.

Other objects and advantages of the present invention will be apparent from the following description of the preferred embodiments.

DESCRIPTION OF THE PREFERRED EMBODIMENTS

Figure 1:
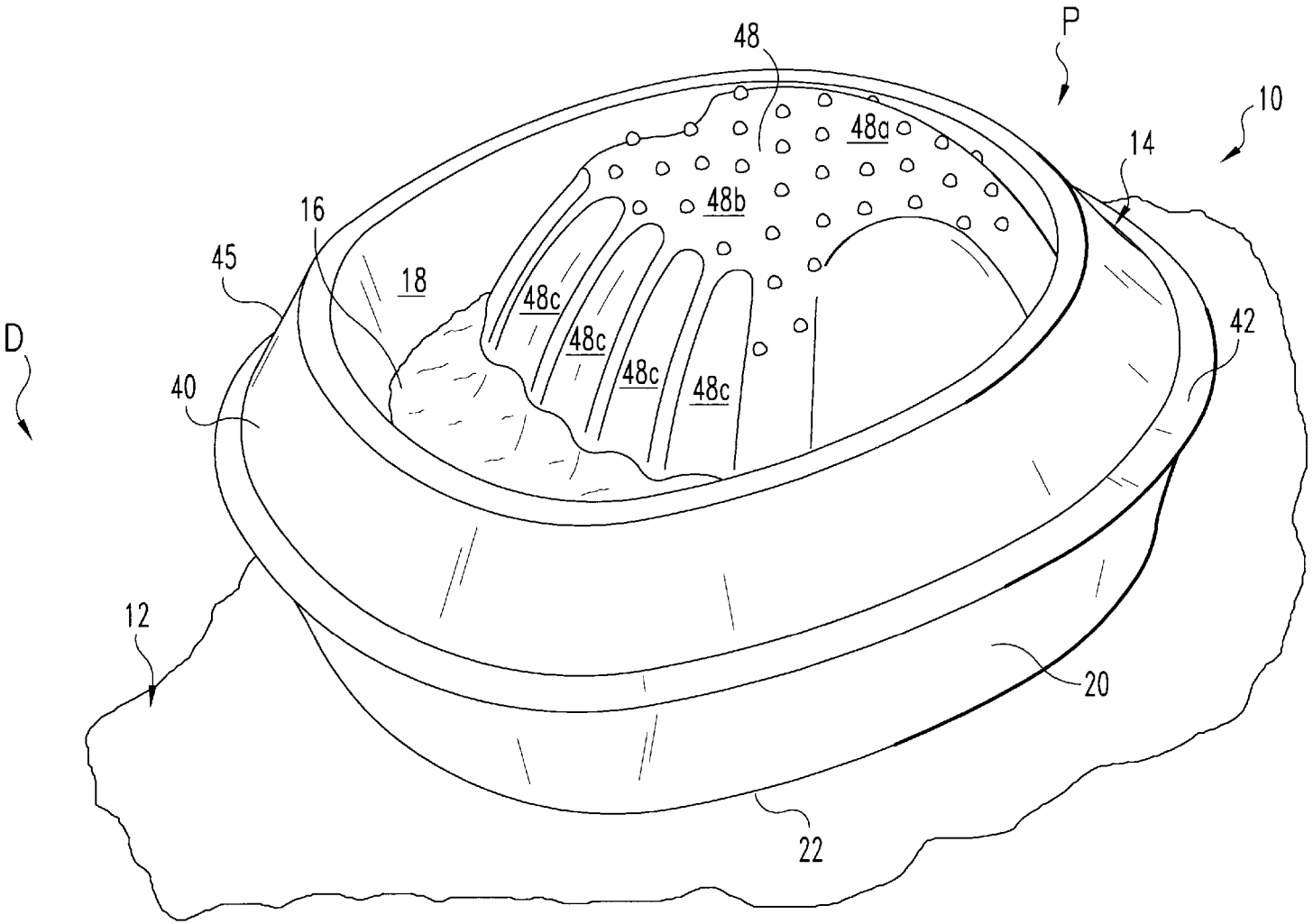
FIG. 1 is a perspective view of a hand treatment device according to at least one embodiment of the present inventions.

For the purposes of promoting an understanding of the principles of the inventions, reference will now be made to the embodiments illustrated in the drawings and specific language will be used to describe the same. It will nevertheless be understood that no limitation of the scope of the inventions is thereby intended. Any such alterations and further modifications in the illustrated device, and any such further applications of the principles of the invention as illustrated therein are contemplated herein as would normally occur to one skilled in the art to which the inventions relate.

Referring to FIG. 1, there is illustrated therein a perspective view of a hand treatment device according to at least one embodiment of the present inventions. Hand treatment device 10 is supported upon a surface 12 that is preferably the top of a table or counter that conveniently and comfortably locates device 10 with respect to the user or person to receive treatment. Hand treatment device 10 includes a housing 14 that defines a basin 18. The basin 18 retains a treatment fluid 16 therein. The user of treatment device 10 can place his or her hand on a hand rest 48 positioned within the housing 14 so that at least the fingers of the user extend into basin 18 and are at least partially submerged in treatment fluid 16. Treatment fluid 16 is circulated within basin 18 by a pump or compressor, as described in detail below, to provide a continuous flow of treatment fluid 16 about the fingers of the user. Treatment fluid 16 may be water, oil, or other solution useful for treating the hand and fingers.

Treatment fluid 16 may be cold or hot, depending on the type of therapy desired. Treatment fluid 16 can also provide aromatherapy to the user as it is circulated in the basin. A water soluble oil can be added to treatment fluid 16 to provide various aromas for energy, relaxation, or therapeutic purposes. For example, a lavender aroma could be used for relaxation or a rosemary aroma for energy.

Figure 2:
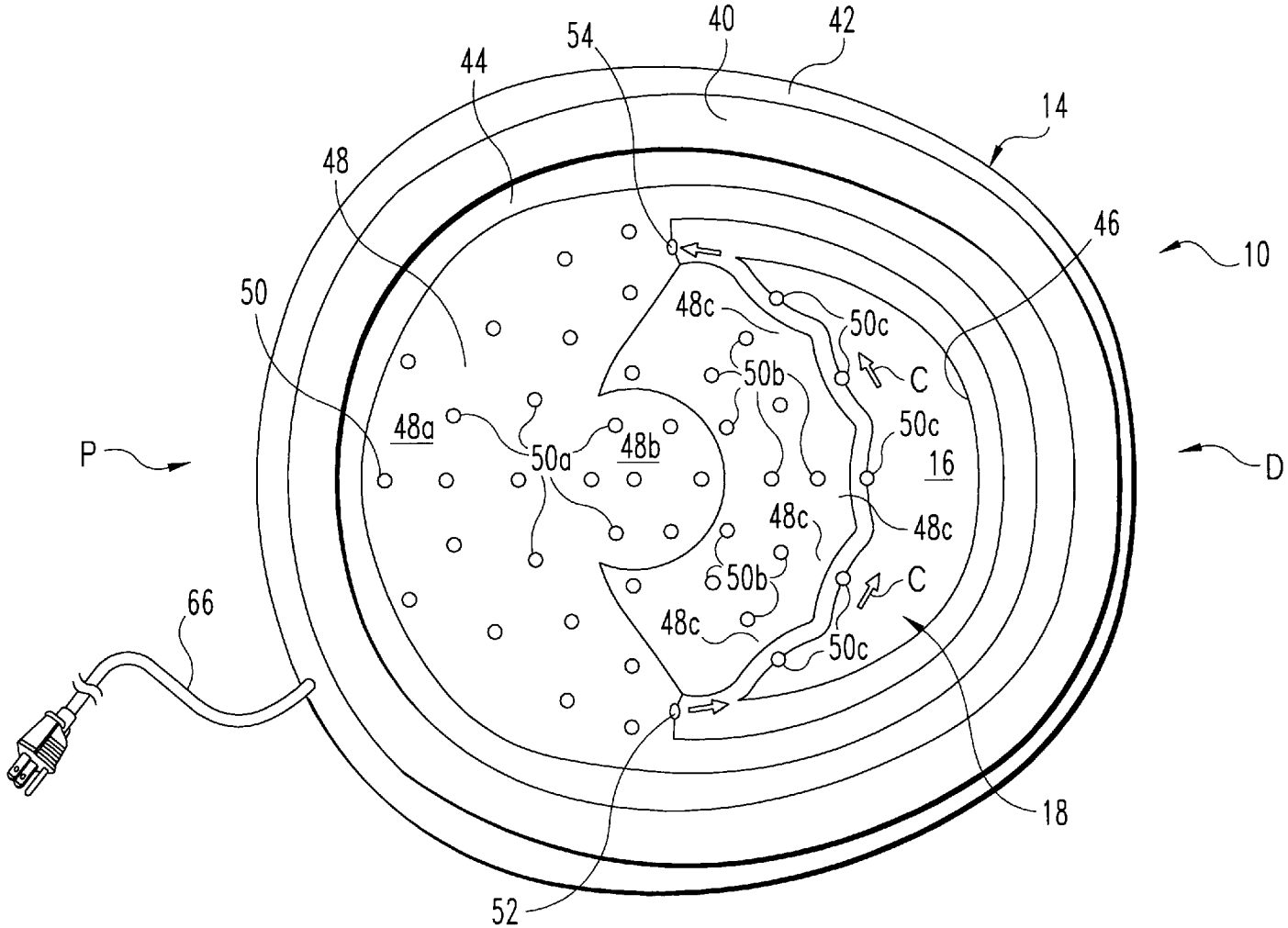
FIG. 2 is a top plan view of the hand treatment device, such as one embodiment of the hand treatment device of FIG. 1.
Figure 3:
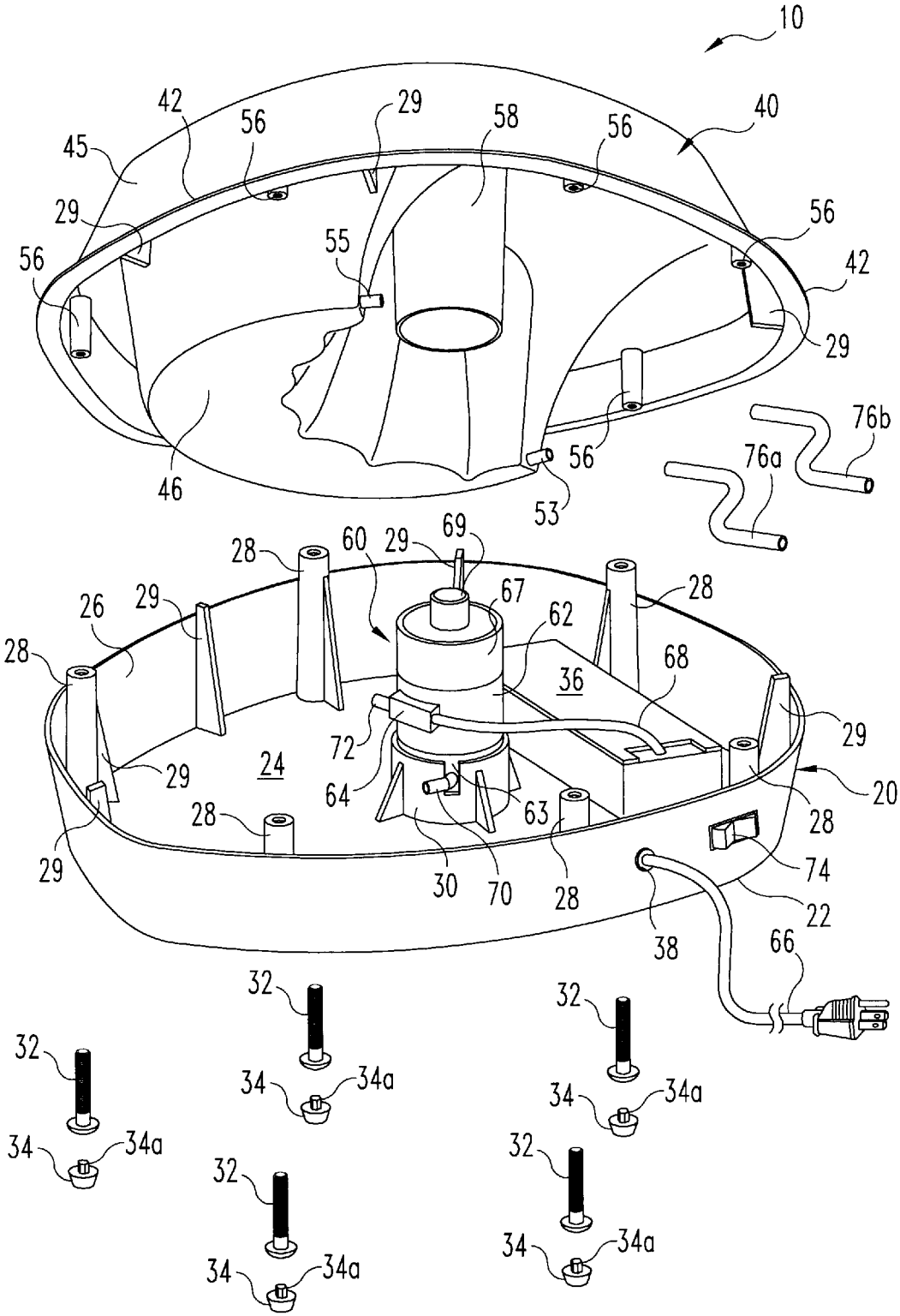
FIG. 3 is an exploded perspective view of the treatment device of FIG. 2.

A first preferred embodiment of the present inventions will now be more specifically described. Referring more specifically to FIGS. 1–3, housing 14 includes a base 20 having a bottom surface 22 which may rest upon surface 12, or may be spaced from surface 12 by non-skid feet (34 of FIG. 3) affixed to bottom surface 22. Connected with base 20 is upper portion 40. A flange 42 is provided at the interface between upper portion 40 and base 20. Flange 42 extends outwardly from upper portion 40 and downwardly towards surface 12 to prevent treatment fluid 16 entering into housing 14 at the junction of base 20 and upper portion 40. Upper portion 40 includes a rim 44 defining an opening around the top of housing 14 that allows placement of treatment fluid 16 in basin 18 and the user's hand on hand rest 48. An upper wall 45 extends between flange 42 and upper rim 44. Wall 45 and hand rest 48 define basin 18 such that it preferably forms a substantially semi-circular shape. Other shapes for basin 18 are also contemplated.

Upper portion 40 includes first fluid opening 52 and second fluid opening 54 adjacent to basin 18 and positioned at opposite sides of the basin 18. Openings 52 and 54 provide a path for a pump to circulate treatment fluid 16 through basin 18 along a semi-circular path as indicated by arrows C. This advantageously moves the treatment fluid across and substantially perpendicularly to the user's fingertips and cuticles to better treat the hands.

Treatment device 10 includes hand rest 48 having three portions 48*a*, 48*b*, and 48*c*. Hand rest 48 has wrist support portion 48*a* formed with a proximal end P of upper rim 44. Wrist support portion 48*a* extends distally towards basin 18 to palm support portion 48*b*. Hand rest 48 includes finger support portion 48*c* extending downwardly from palm support portion 48*b* to a bottom surface 46 of basin 18. Hand rest 48 is molded from a plastic material, and the portions 48*a*, 48*b*, and 48*c* are smooth and rounded and include smooth and rounded transitions between the portions to accommodate the hand in comfortable fashion. Preferably, hand rest 48 can comfortably accommodate either the right or left hand of the user.

Portion 48*a* of hand rest 48 defines a concave surface extending along wall 45 from proximal side P to bottom surface 46 of basin 18. Portion 48*a* transitions to portion 48*b*, which is slightly elevated above portion 48*a* and configured to support the palm of the user with portion 48*a* accommodating the heel of the hand and the wrist. Hand rest 48 also includes finger-receiving portions 48*c* which are sized, spaced and configured to accommodate each of the fingers of the user's hand when the palm is resting on portion 48*b*. Hand rest 48 thus anatomically supports the user's hand during use of the treatment device 10 by portions 48*b* and 48*a*. This allows prolonged use of the treatment device 10 with minimum exertion and strain upon the user's wrist joints.

Hand rest 48 includes a plurality of nodes 50 protruding therefrom. Nodes 50 may be secured directly to the surface of hand rest 48 using an adhesive or a thermo-welding technique. Alternatively, nodes 50 are provided on a membrane positioned below and secured to hand rest 48 within housing 14. Hand rest 48 is provided with a plurality of apertures corresponding in location to the plurality of nodes 50 on the membrane. In either case, the nodes 50 are preferably made from an elastomer and are resilient to provide a cushioning effect to the user's hand resting thereon. In a further embodiment, nodes 50 are integrally molded with and formed from the same material of hand rest 48.

Nodes 50 include nodes 50*a* positioned to be associated with portions 48*a* and 48*b* of hand rest 48. Nodes 50 also include nodes 50*b* positioned along each of the finger receiving portions 48*c*. Nodes 50*a* and 50*b* support the hand and fingers above the surface of the hand rest 48. Optionally, at or adjacent the junction between each of the finger receiving portions 48*c* and bottom surface 46 are nodes 50*c*. The nodes 50*c* support the fingertips of the user within the basin 16 and prevent substantial contact between the fingertips and bottom surface 46. Nodes 50*b* and 50*c* allow treatment fluid 16 to circulate between the fingers of the user and hand rest 48 and bottom surface 46. This circulation about the submerged portions of the hand and fingers allows the entire submerged portion of the hand to receive hydrotherapy from treatment fluid 16 circulating in basin 18. The fingertips and fingernails receive fluid circulation there across so that the fingers and nail are thoroughly cleaned from dirt and grime, and the cuticles are softened and prepared for further manicure or treatment.

Referring now to more specifically to FIG. 3, there is depicted an exploded perspective view of treatment device 10. Base 20 includes an interior area 24 defined by bottom surface 22 and sidewall 26. A number of sleeves 28 positioned around sidewall 26 extend from bottom surface 22 and mate with corresponding connecting portions 56 of upper portion 40. A number of supports 29 are provided along sidewall 26 within interior area 24 of base 20 and along wall 45 within upper portion 40. Supports 29 stabilize and strengthen the walls 26 and 45. When upper portion 40 is assembled to base 20, connecting portions 56 mate with sleeves 28.

A number of fasteners 32 associated with each of the sleeves 28 are inserted into an associated sleeve 28 from bottom surface 22 to connect upper portion 40 with base 20 via connecting portions 56. It is preferred that connecting portions 56 are threaded to mate with threads provided on fasteners 32. However, other means for connecting upper portion 40 to base 20 are also contemplated herein. For example, flange 42 and base 20 may be configured to receive clips or other fasteners to connect upper portion 40 with base 20. Upper portion 40 and base 20 could also be provided with tabs and associated recesses configured to fit base 20 and upper portion 40 together.

A number of feet 34 are also associated with each of the sleeves 28 to support bottom surface 22 above surface 12. Each foot 34 is preferably made from a rubber or resilient material that absorbs vibration of the device 10 during use, allowing device 10 to rest securely on surface 12. In one embodiment, each foot 34 includes a threaded portion 34*a* allowing the height of device 10 to be adjusted and leveled with respect to surface 12.

Upper portion 40 includes a cylindrical housing 58 extending below portion 48*b* of hand rest 48 sized and shaped to receive a portion of motor assembly 60 therein. Upper portion 40 further includes first connection port 53 extending from first opening 52 and a second connection port 55 extending from second opening 54. Connection port 53 connects with first tube 76*a*, and connection port 55 connects with second tube 76*b*. Tubes 76*a* and 76*b* are preferably made from flexible material, and slide over its respective connecting port 53, 55 to form a fluid-tight seal therewith. It is also contemplated that clamps or the like may be provided to connect tubes 76*a* and 76*b* to connecting ports 53 and 55. Tubes 76*a* and 76*b* also may be connected with connecting ports 53 and 55 via a thermo-weld or an adhesive.

Base 20 includes a receptacle 30 positioned on bottom surface 22 for receiving motor assembly 60 therein. For purposes of clarity, motor assembly 60 is illustrated in diagrammatic form in FIG. 3. Motor assembly 60 is preferably secured to the receptacle 30 in a manner that minimizes movement of the motor assembly 60 within base 20. Motor assembly 60 includes a motor 62 and a pump 63 coupled with motor 62. Pump 63 includes an inlet 72 and an outlet 70. Tube 76*a* connects port 53 to pump outlet 72, and tube 76*b* connects port 55 to pump inlet 70. Pump 63 is operable by motor 62 to circulate fluid 16 through basin 18. As shown in FIG. 2, pump 63 circulates fluid 16 in basin 18 from first opening 52 to second opening 54 in the direction indicated by arrows C. Thus, fluid is continuously circulated in basin 18 across the fingers and fingertips positioned in fluid 16. It should be apparent that pump 63 may be so arranged to circulate fluid in the direction opposite arrows C. Motor assembly 60 may be selected from any one of a number of commercially available pump and motor assemblies, the selection of which is believed within the ordinary skill in the art. Treatment fluid is drawn from the basin 18 by the pump and recirculated. Alternatively, a reservoir included in the housing of the device 10, may be used by the pump to provide treatment fluid to the basin.

Motor assembly 60 includes electrical junction box 64 coupled to a wire 68 extending to a power source. In one embodiment, the power source is a series of batteries positioned within a battery compartment 36 formed in base 20. The batteries are electrically connected via wire 68 to provide a source of DC power to motor 62 sufficient to operate pump 63. The use of DC power is desirable in that it allows treatment device 10 to be easily transported and used for treatment at virtually any location. In an alternative embodiment, wire 68 extends from housing 14 to AC plug adapter 66, providing a source of AC power to operate pump 63. Device 10 can include a transformer that allows power to be stepped up or down as necessary for optimal performance of the device 10. In a further embodiment, the device 10 includes an AC/DC converter allowing use of either DC power or AC power as desired. Lower portion 20 includes an opening through the side wall to accommodate on/off switch 74 connected to the power source within the hand treatment device, which is used to turn on and off the power source.

The present invention further contemplates that motor assembly 60 includes a mechanical vibrator 67. Vibrator 67 is coupled to hand rest 48 via coupling 69. When vibrator 67 is activated, the coupling 69 reciprocates in a manner that provides a vibratory force to hand rest 48. This vibratory force is transmitted through the nodes 50 to deliver a therapeutic massage to the hand positioned thereon. It is contemplated herein that device 10 include circuitry allowing pump 63 to be activated via switch 74 to circulate fluid in basin 18 either with or without activation of vibrator 67; and that vibrator 67 can be activated via switch 74 to massage the hand without activating pump 63. In such an embodiment, it is contemplated that switch 74 may be a three position rocker type switch.

If desired, the fluid may be heated using a resistive heating element attached to the basin and powered by the power source, such as is shown in U.S. Pat. No. 4,441,487 to Daugherty, that patent incorporated herein by reference. Optionally, a heating element may be in communication with one or both of the treatment fluid inlet tubes 76*a* and 76*b* to provide heated treatment fluid to the basin 18.

Figure 4:
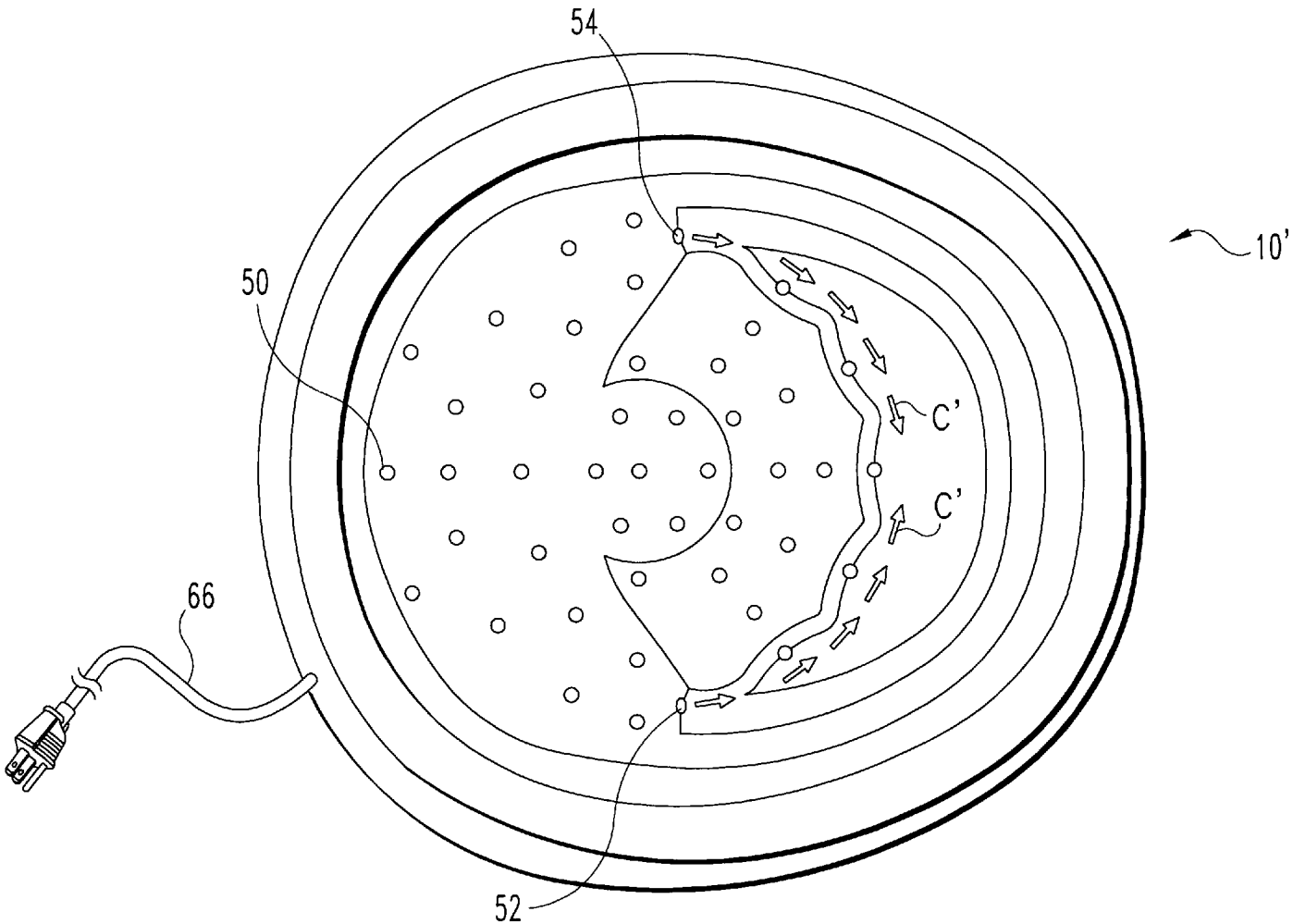
FIG. 4 is a top plan view of the hand treatment device, such as another embodiment of the hand treatment device of FIG. 1.
Figure 5:
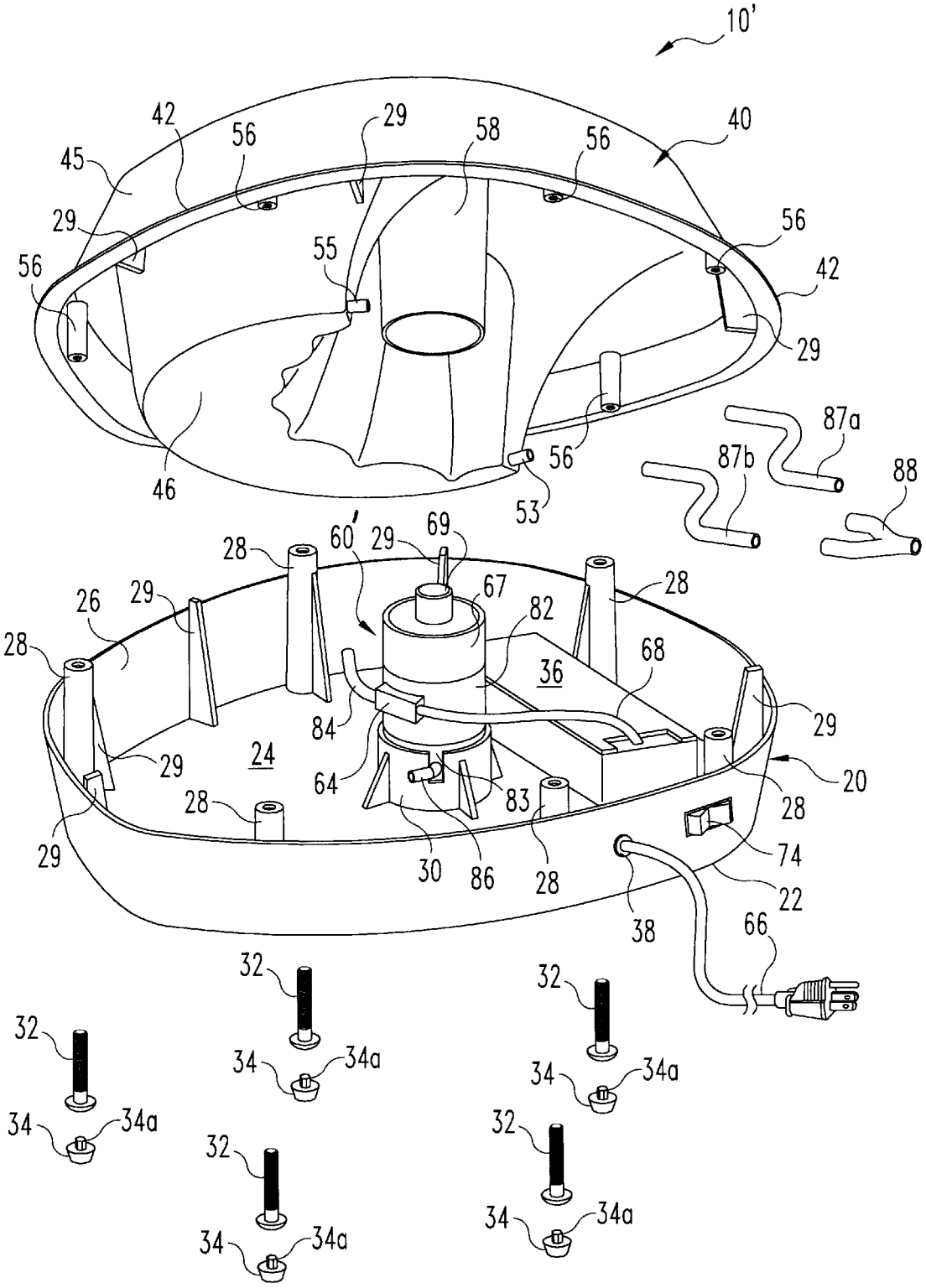
FIG. 5 is an exploded perspective view of the treatment device of FIG. 4.

Referring now to FIGS. 4–5, there is shown another embodiment of the hand treatment device, designated as 10'. Device 10' is similar in almost all respects to treatment device 10, except as described below. For example, a vibrator 67 and an optional heater may be included in communication with the basin 18, if desired.

Instead of using a pump 62 to pump treatment fluid into the basin and across the user's finger tips, treatment device 10' includes a motor assembly 60' having a motor 82 coupled with an air compressor 83. An air intake hose 84 extends through wall 26 to provide an air inlet to compressor 83. Compressed air is sent from compressor 83 through outlet 86 to tubes 87*a* and 87*b* via "Y"-connector 88. Tubes 87*a* and 87*b* are connected with connecting portions 53, 55 to deliver compressed air through opening 52, 54 communicating with basin 18. As compressed air is ejected into basin 18, the air circulates treatment fluid 16 in the directions C' within the basin 18 by agitating the fluid to provide treatment and therapy to the hand. It is also contemplated that a single tube 87 could be connected to outlet 86 and one of the ports 52 or 54. As with the embodiment of FIGS. 2–3, the injected compressed air advantageously moves the treatment fluid across and approximately perpendicularly to the user's fingertips and cuticles to better treat the hands.

Figure 6:
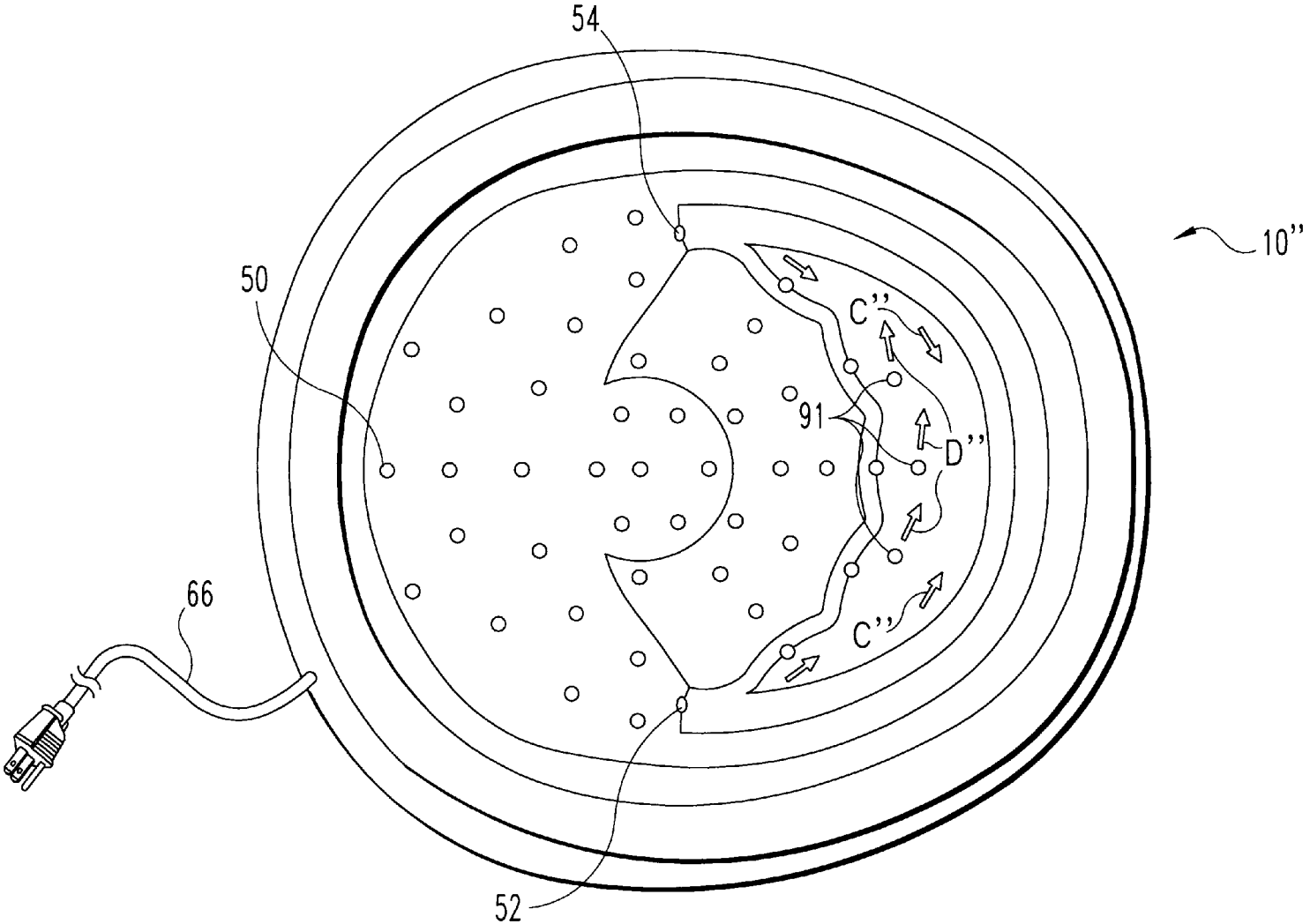
FIG. 6 is a top plan view of the hand treatment device, such as another embodiment of the hand treatment device of FIG. 1.
Figure 7:
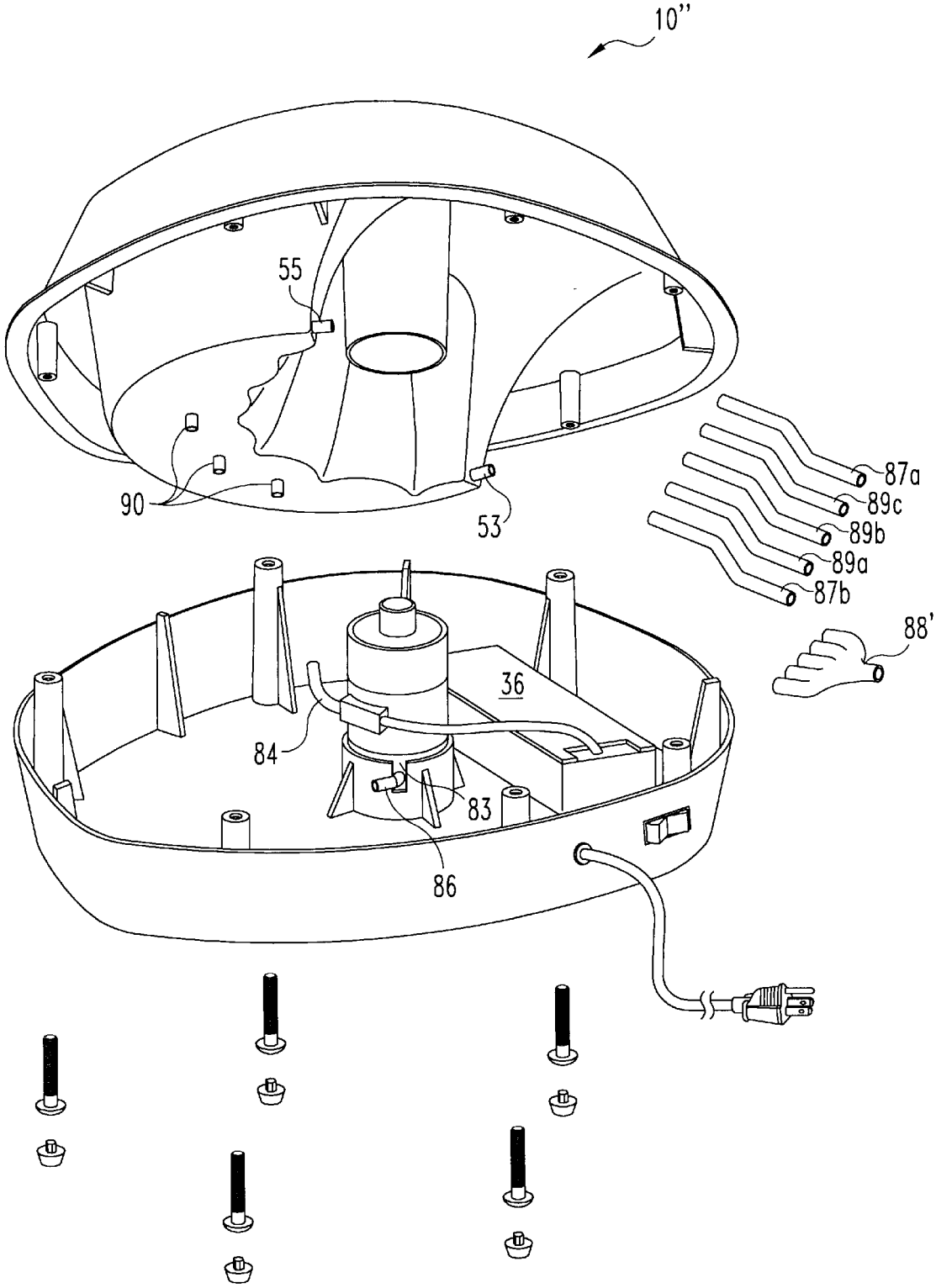
FIG. 7 is an exploded perspective view of the treatment device of FIG. 6.

Referring now to FIGS. 6–7, there is shown another embodiment of the hand treatment device, designated as 10". Device 10" is similar in almost all respects to treatment device 10' of FIGS. 4–5, however, instead of merely including a "Y" connector, a multiple connector connects the compressor 83, not only to 53 and 55, but also to connecting portions 90, via tubes 89*a*, 89*b* and 89*c*. Connecting portions 90 communicate with openings 91 in the bottom of the basin 18. Thus, compressed air is sent from compressor 83 through outlet 86 to tubes 87*a*, 87*b*, 89*a*, 89*b* and 89*c* via multi-connector 88' into the basin 18. This causes the fluid to flow in the directions of directional arrows C" and D", and additionally aerates the treatment fluid. As with the embodiment of FIGS. 4–5, the injected compressed air advantageously moves the treatment fluid across and approximately perpendicularly to the user's fingertips and cuticles to better treat the hands. Additionally, the compressed air flowing upward from the bottom of the basin in the direction of directional arrows D" further agitates the treatment fluid around the tips of the fingers, providing therapy to the finger tips and further cleaning the nails.

Optionally, if direct treatment of the cuticles via the approximately perpendicular flow across the cuticles in direction C" is not desired for a particular application, tubes 87*a* and 87*b*, and connecting ports 53 and 55 may be omitted. The user's fingertips, and nails may still be treated and cleansed by the treatment fluid agitated by the compressed air through openings 91.

Figure 8:
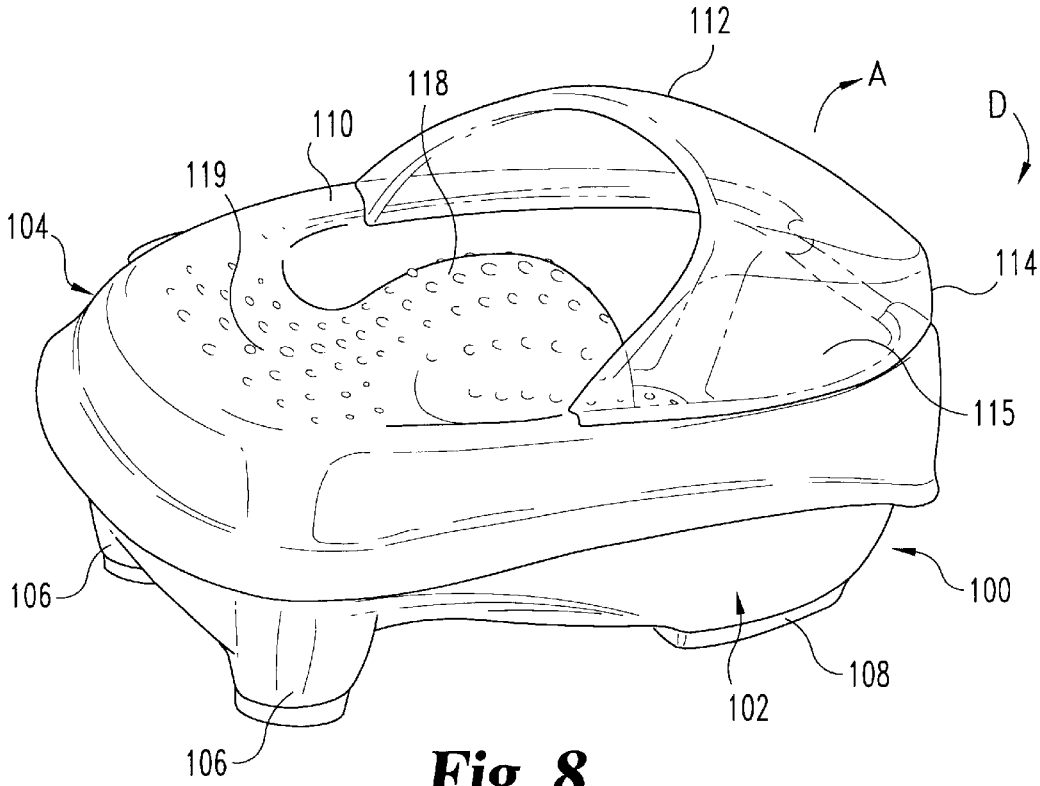
FIG. 8 is a perspective view of a hand treatment device according to an embodiment of the present inventions.
Figure 9:
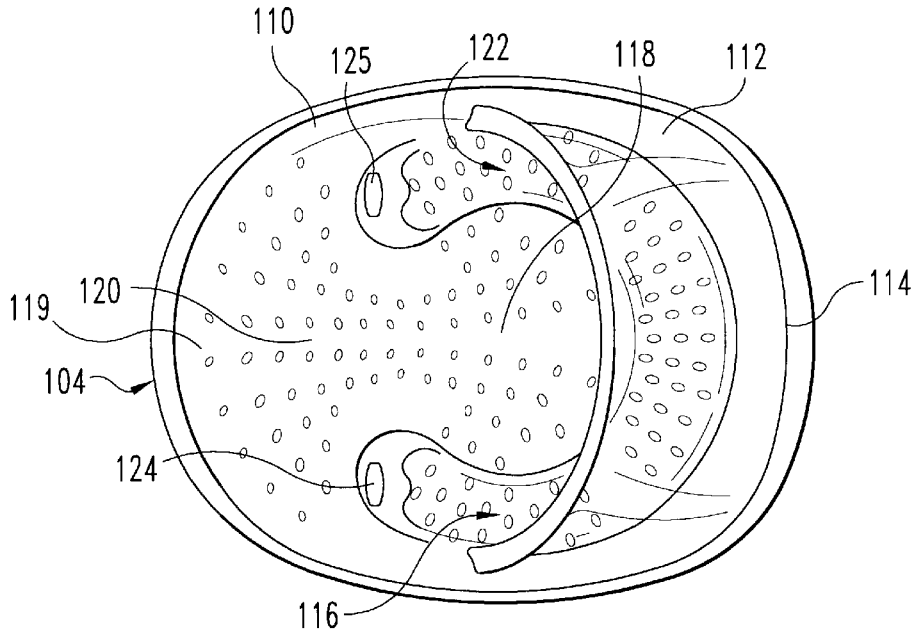
FIG. 9 is a top plan view of another embodiment of the hand treatment device of FIG. 8.

Referring now to FIGS. 8–9 there is shown a further embodiment of a hand treatment device according to the present inventions. Treatment device 100 is similar in many respects to treatment devices 10, 10' and 10", and may be provided with a pump or a compressor and accompanying openings, tubes and connecting ports, as described in connection with the embodiments of FIGS. 1–7. Device 100 includes a base 102 and an upper portion 104 connected therewith. Base 102 includes rear legs 106 at its proximal end P and basin support 108 at its distal end D for supporting device 100 on a surface. Upper portion 104 includes rim 110 therearound. A semi-circular basin 116 is defined by a wall 115 of upper portion 104 and a hand rest 118 positioned within upper portion 104.

A splashguard 112 is optionally supported on rim 110 about the wall 115 above basin 116. Splashguard 112 contains treatment fluid that may splash or spray within the basin 116 as the fluid is circulated in the basin. Splashguard 112 is preferably pivotally attached to rim 110 at forward end 114 such that it may be rotated away from rim 110 in the direction indicated by arrow A. When rotated, the user's hand is easily inserted into basin 116 with the palm positioned on hand rest 118 and the wrist supported on portion 119. Splashguard 112 may then be rotated downwardly to enclose the user's hand in basin 116. It is also contemplated that splashguard 112 may be completely removable from the device 100. It is preferred that splash guard 112 made from a plastic material, and have a clear or smoky color to allow visualization and monitoring of basin 116 and the progress of the treatment of the user's hand.

Hand rest 118 and wrist support 119 include a plurality of nodes 120 for providing massage therapy, as discussed above with respect to nodes 50. The bottom surface of basin 116 also includes a plurality of nodes 122, which serve to further agitate the water circulating in basin 116 for therapeutic effect.

Figure 10:
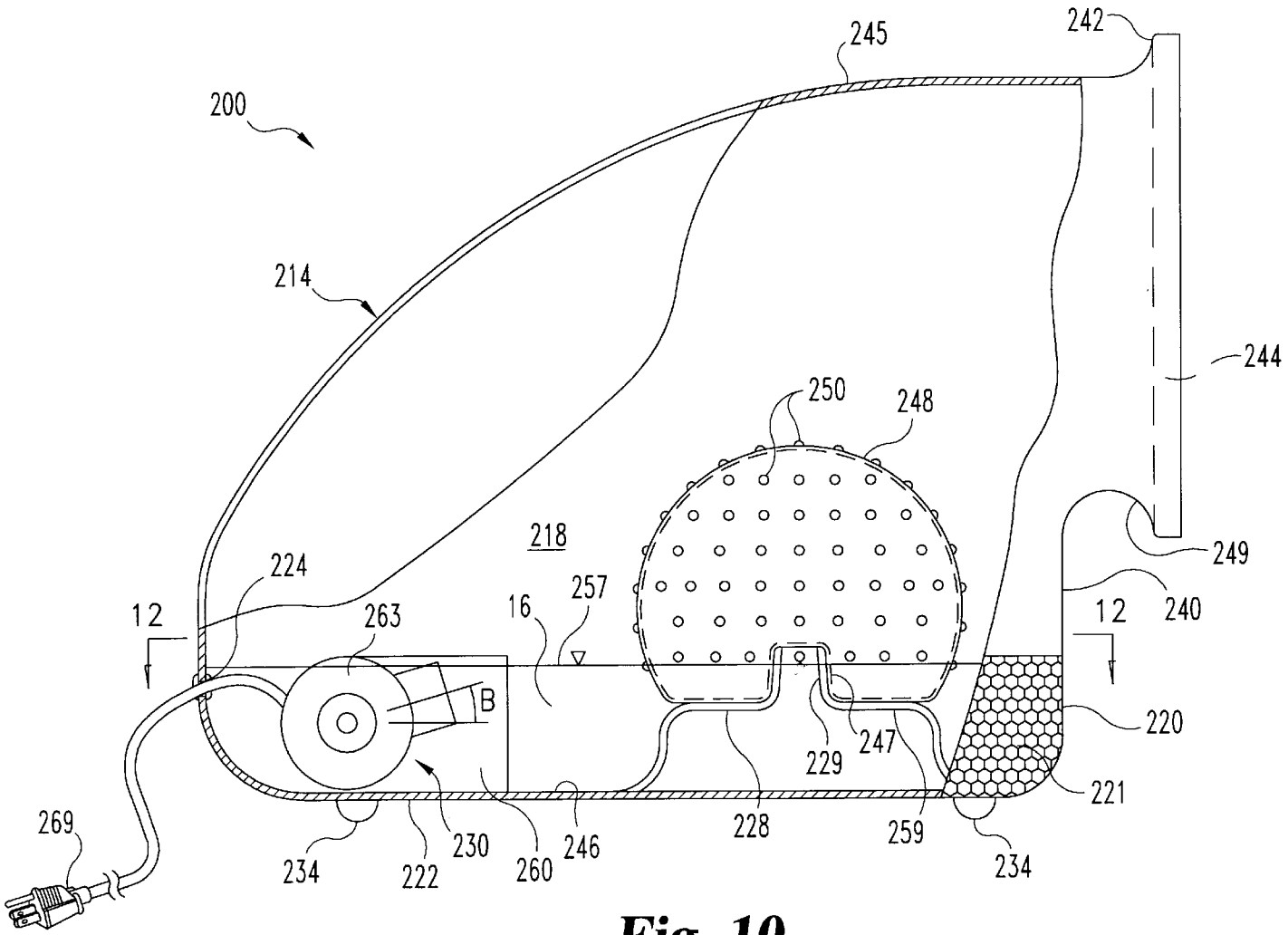
FIG. 10 is a side elevational view in partial section of a further embodiment hand treatment device.
Figure 11:
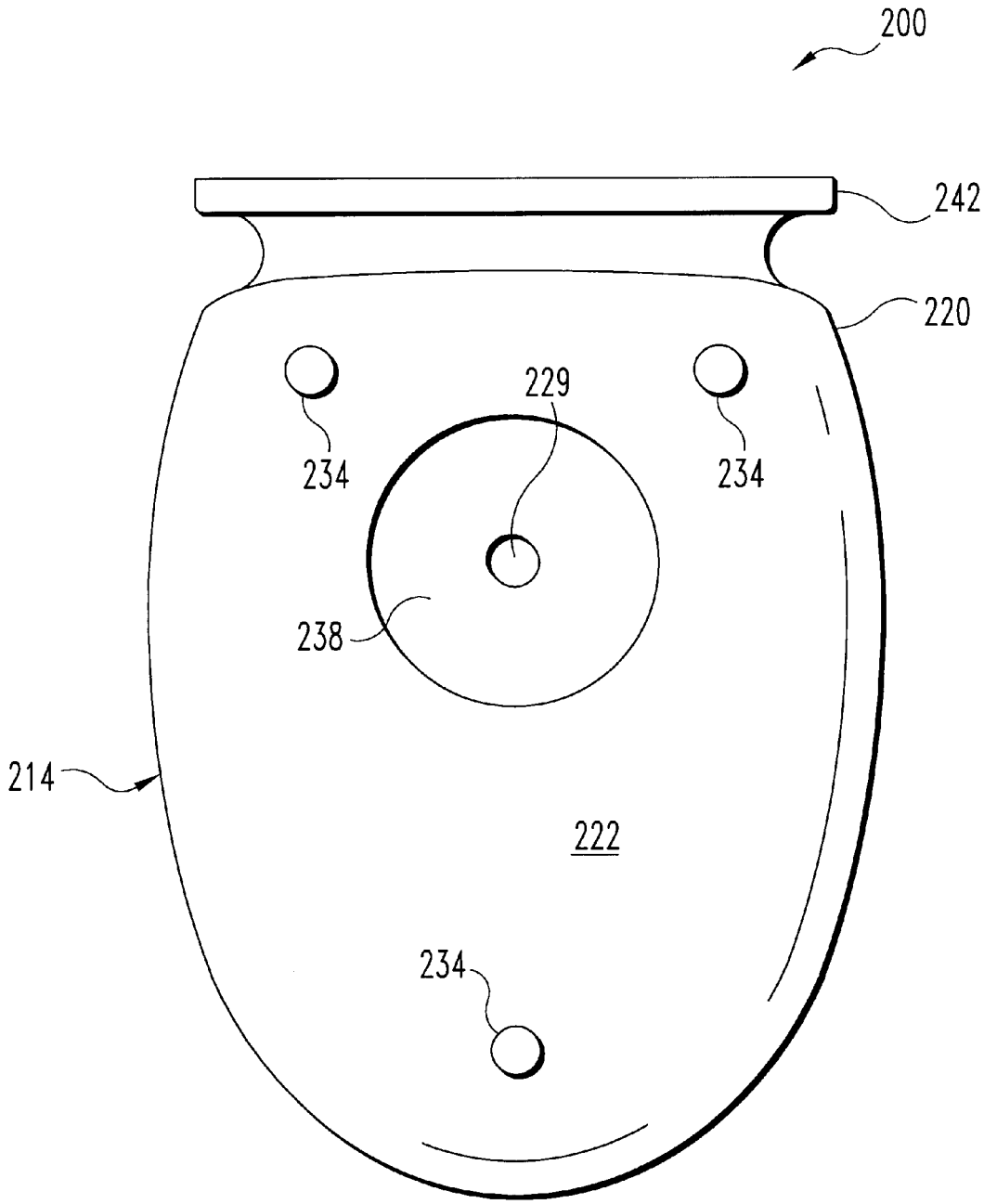
FIG. 11 is a bottom plan view of the hand treatment device of FIG. 10.
Figure 12:
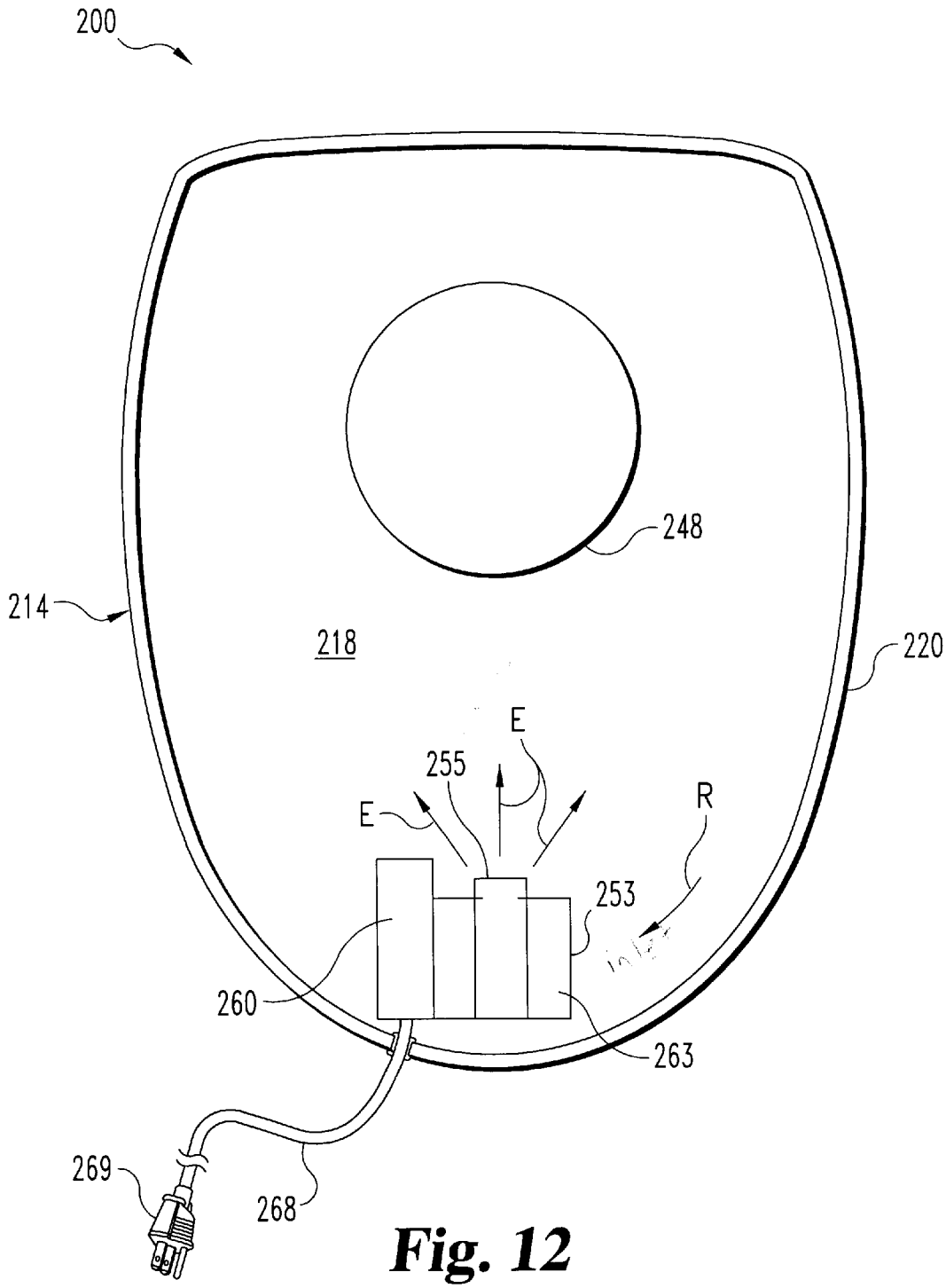
FIG. 12 is a cross-sectional view taken through line 12—12 of FIG. 10.

Referring now to FIGS. 10–12 there is shown a further embodiment of a hand treatment device according to the present inventions. Treatment device 200 is similar in many respects to treatment devices 10, 10' and 10". In addition to or as an alternative to the fluid circulation system described hereinbelow with respect to treatment device 200, treatment device 200 may be provided with a pump or a compressor and accompanying openings, tubes and connecting ports, as described in connection with the embodiments of FIGS. 1–9. Treatment device 200 can further be provided with a vibratory handrest and a heater to heat treatment fluid 16.

Treatment device 200 includes a housing 214 that defines a basin 218. Basin 218 retains a treatment fluid, such as treatment fluid 16, therein. The user of treatment device 200 can place his or her hand on a hand rest 248 positioned within the housing 214 so that at least the fingers of the user extend into basin 218 and are submerged in treatment fluid 16. Treatment fluid 16 is circulated within basin 218 by a pump or compressor, as described in detail below, to provide a continuous flow of treatment fluid 16 onto the fingers of the user.

Housing 214 includes a base 220 that can be adorned with surface etchings 221 on its outer surface. Base 220 has a bottom wall 222 which may rest upon surface 12 (FIG. 1), or may be spaced from surface 12 by feet 234 affixed to or integrally formed with bottom wall 222. Connected with and preferably formed as an integral unit with base 220 is upper portion 240. Upper portion 240 includes an opening 244 and a hood portion 245 that extends over hand rest 248. Hood portion 245 extends between flange 242 and base 220. Hood portion 245 substantially encloses basin 218, preventing fluid from splashing out of basin 218 during treatment. Opening 244 is vertically oriented and sized to receive the hand of the user therethrough so it can be comfortably positioned on hand rest 248. A flange 242 is provided around the opening 244. Opening 244 also provides a way for treatment fluid 16 to be place into basin 218.

Treatment device 200 includes hand rest 248 having a semi-spherical shape truncated along a bottom 259 of the hand rest 248. Hand rest 248 supports the palm of the user's hand with the fingers positioned towards a bottom surface 246 of basin 218, with at least the ends of the fingers submerged in treatment fluid 16 in basin 218. A wrist support portion 249 formed at opening 244 supports the user's wrist. The spherical portion of hand rest 248 further provides the user an object to squeeze or grip as desired for further therapy. Hand rest 248 is preferably molded from a plastic material, and is smooth and rounded to accommodate the hand in comfortable fashion. Preferably, hand rest 248 can comfortably accommodate either the right or left hand of the user. Hand rest 248 further includes a plurality of nodes 250 protruding therefrom. Nodes 250 can be provided on a membrane positioned in or around hand rest 248. Nodes 250 are preferably made from an elastomer and are resilient to provide a cushioning effect to the user's hand resting thereon. In a further embodiment, nodes 250 are integrally molded with and formed from the same material of hand rest 248.

Base 220 includes a hand rest support 228 formed in bottom wall 222. Hand rest support 228 is in the form of a raised platform that includes a mount 229 extending upwardly therefrom. Hand rest 248 includes a recess 247 formed therein in its bottom surface that is positionable over mount 229. Hand rest 248 can be immovably secured to mount 229. In an alternate form, hand rest 248 can be pivotably secured to mount 229 in a manner that allows limited movement of hand rest 248 so the user can move his or her wrist without releasing his or her grip on hand rest 248. Hand rest support 228 preferably has a height that positions the top of hand rest 248 slightly above wrist support 249, thereby allowing hand rest 248 to deflect any treatment fluid that might be splashed towards opening 244 when the pump is started.

Treatment device 200 includes a motor 260 and a pump 263 coupled to motor 260. Pump 263 includes an inlet 253 through which treatment fluid 16 enters pump 263. Treatment fluid 16 exits pump 263 through an opening of outlet 255 towards hand rest 248. The preferred fill line 257 in basin 218 is located so that the treatment fluid covers inlet 253, but when treatment fluid 16 is circulated by pump 263 the surface of treatment fluid 16 is disturbed such that air is drawn into pump 263. This causes slight cavitation during operation of pump 263, providing air bubbles in the treatment fluid and eliminating the need for a separate compressor to create such bubbles. However, it should be understood that the use of a separate compressor with treatment device 200 is not precluded, and that the fill line 257 could be positioned such that no cavitation occurs.

As shown in FIG. 12, pump 263 circulates fluid 16 in basin 218 from outlet 255 towards hand rest 248 where the treatment fluid is directed against the nails and cuticles of the user's hand. Treatment fluid is drawn from basin 218 into inlet 253 as indicated by arrow R. Treatment fluid 16 is injected into basin 218 through outlet 255 in a fan-like pattern as indicated by arrows E. Outlet 255 is preferably pivotal with respect base 220, and in the illustrated embodiment is oriented at an angle B of about 30 degrees. The angle B can be adjusted as desired by the user to direct the flow of treatment fluid from pump 263 as desired.

Motor 260 and pump 263 may be selected from any one of a number of commercially available pump and motor assemblies, the selection of which is believed within the ordinary skill in the art. In the illustrated embodiment, motor 260 and pump 263 are submersible in treatment fluid 16. Motor assembly 260 is coupled to a wire 268 extending to a power source, and provides a power supply to pump 263. Wire 268 extends from housing 214 to a suitable three pin AC plug adapter 269. Plug adapter 269 preferably includes a 120 to 24 volt step-down transformer which for added safety is also provided with an isolating screen between the windings which is permanently connected to its grounded third pin.

Base 220 includes an opening 224 through a wall of the base 220 to accommodate cord 268. It is contemplated that a strain relief bushing can be provided in hole 224 between cord the 268 and the wall. Preferably, hole 224 is not sealed watertight so it can serve the further function as an overflow outlet to prevent overfilling of basin 218.

It is also contemplated that treatment device 200 can include a mechanical vibrator coupled to hand rest 248, such as the mechanical vibrator 67 discussed above. It is contemplated herein that treatment device 200 include circuitry allowing pump 263 to be activated via a switch to circulate fluid in basin 218. If desired, the fluid may be heated as discussed above with respect to treatment device 10.

Figure 13:
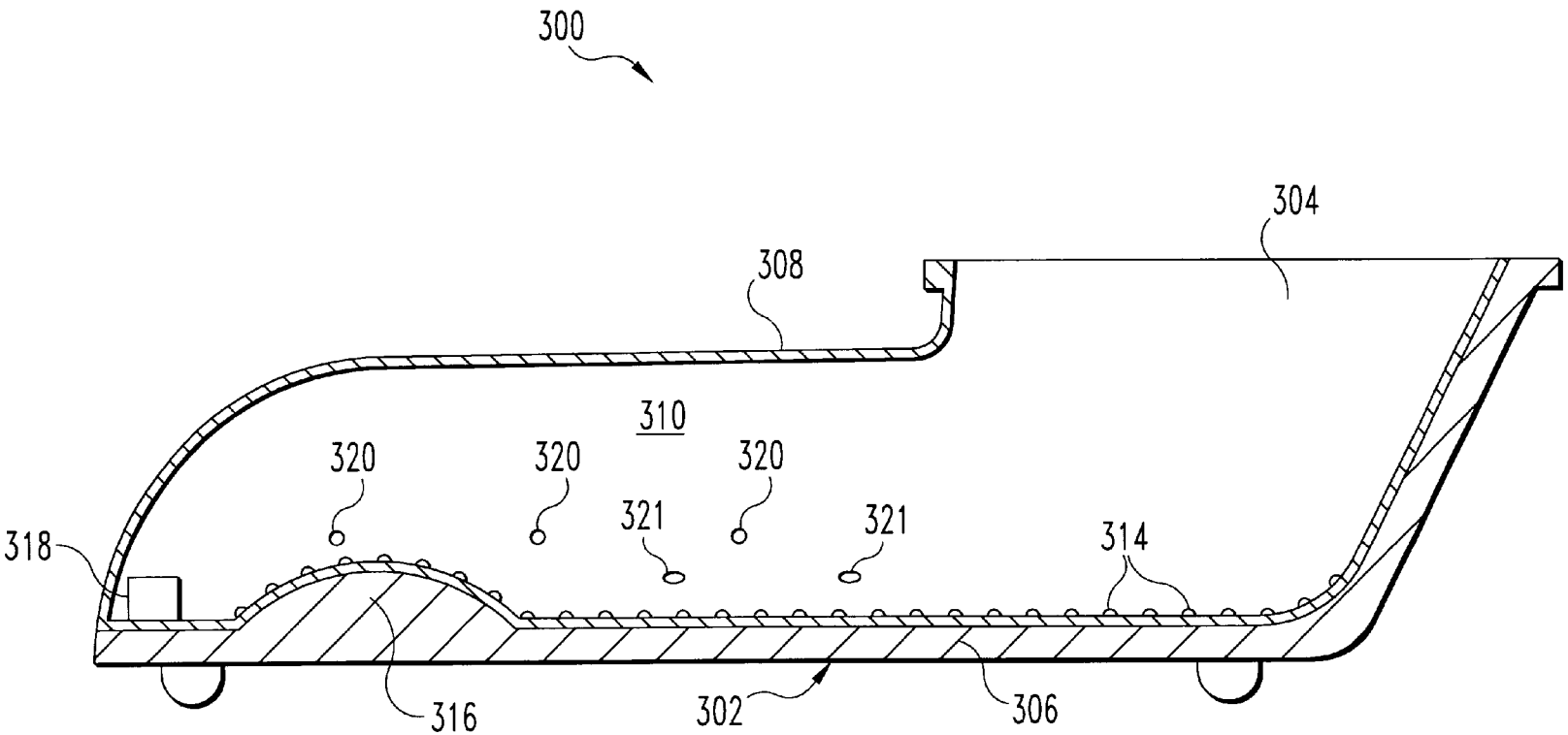
FIG. 13 is a sectional view of another embodiment treatment device adapted to treat the hand and lower arm.

Referring now to FIG. 13, another embodiment of a treatment device is provided that is adapted to receive and treat the hand and lower arm of the user. Except as described below, treatment device 300 can be similar in many respects to treatment devices 10, 10' and 10" and 200. Treatment device 300 may be provided with a pump, compressor, vibrator, and heater along with the accompanying openings, tubes and connecting ports, as described in connection with the embodiments discussed above, to circulate and heat treatment fluid and to provide massage therapy to the hand, wrist and lower arm of the user.

Treatment device 300 includes a housing 302 having an opening 304. Housing 302 is elongated to comfortably accommodate the hand and forearm of the user, and opening 304 is sized to allow for insertion of the hand and forearm of the user. Housing 302 includes a bottom wall 306 and an upper wall 308 that define a basin 310 for holding a treatment fluid. Bottom wall 306 preferably has a surface configuration in basin 310 that comfortably supports the hand, wrist and forearm of the user. In the illustrated embodiment, bottom wall 306 includes a raised portion 316 that supports the user's hand. A membrane 312 can be provided to line at least the bottom portion of basin 310. Membrane 312 can include a number of nodes 314 extending therefrom to support the hand and forearm and allow fluid circulation between the membrane and the forearm and hand of the user.

Housing 302 can be provided with a pump 318 to circulate fluid in basin 310. It is further contemplated that tubing can be provided to connect pump 318 to holes 320 provided in the sidewalls of housing 302 to direct fluid against the sides of the hand, wrist, and forearm of the user. It is further contemplated that holes and tubing could be provided in bottom wall 306 to direct fluid flow upwardly against the hand, wrist and forearm of the user. Intake holes 321 can be provided in housing 302 and connected to pump 318 to return treatment fluid thereto for re-circulation.

While the invention has been illustrated and described in detail in the drawings and foregoing description, the same is to be considered as illustrative and not restrictive in character, for example, it is understood that where openings into the basin are described, fewer or greater numbers of openings into the basin for ingress of compressed air or treatment fluid may be provided. It being understood that only the preferred embodiments have been shown and described and that all changes and modifications that come within the spirit of the invention are desired to be protected.

What is claimed is:

1. A device for treating a hand, comprising:

a housing having a basin for retaining a treatment fluid therein, a hand rest positioned within the housing adjacent the basin, the hand rest having a surface configured for supporting the hand in relation to the basin with at least a portion of the hand submerged in the treatment fluid in the basin, further including at least one opening communicating with the basin; and means submerged in the treatment fluid and disposed within the housing connected with the at least one opening for continuously circulating the treatment fluid in the basin thereby providing therapy to the submerged portion of the hand.

2. The device of claim 1, further comprising a plurality of nodes extending above the surface of the hand rest for supporting the hand above the surface of the hand rest.

3. The device of claim 2, wherein the hand rest is semi-spherical.

4. The device of claim 2, further comprising means positioned within the housing for applying a vibratory force to the hand rest, wherein the nodes transmit the vibratory force to the hand to provide massage therapy.

5. The device of claim 1, wherein the at least one opening includes a second opening communicating with the basin, the first and second openings submerged in the treatment fluid in the basin, and the means for circulating includes a pump having an outlet connected with the first opening and an inlet connected with the second opening, whereby the pump circulates the treatment fluid in the basin between the first and second openings.

6. The device of claim 1, wherein the means for circulating includes an air compressor having an air outlet connected to the at least one opening, whereby the air compressor circulates the treatment fluid by supplying air into the treatment fluid in the basin.

7. The device of claim 1, wherein the means for circulating includes a pump submerged in the treatment fluid and in communication with the at least one opening, the hand on the hand rest being positioned between the opening and the hand rest.

8. The device of to claim 1, further including a heater in communication with the basin to heat the treatment fluid contained therein.

9. The device of claim 1, wherein the at least one opening is submerged in the treatment fluid in the basin.

10. The device of claim 1, wherein the hand rest is pivotally supported in the housing.

11. The device of claim 1, wherein said at least one opening is moveable relative to the basin to position the at least one opening at any one of a number of positions in the basin corresponding to a level of the treatment fluid in the basin.

12. A device for treating a hand, comprising:

a housing having a basin for retaining a treatment fluid therein, a hand rest positioned within the housing adjacent the basin, the hand rest having a surface configured for supporting the hand in relation to the basin with at least a portion of the hand submerged in the treatment fluid in the basin, the housing further including at least one opening communicating with the basin; and a pump in the basin submersible in the treatment fluid, the pump being positioned opposite the hand rest to direct treatment fluid directly against the back of the submerged portion of the hand supported by the hand rest, wherein the pump is operable to continuously circulate the treatment fluid in the basin to provide therapy to the submerged portion of the hand.

13. The device of claim 12, wherein the surface of the hand rest includes a palm support portion and the housing includes:

an opening having a vertical orientation and sized to receive the hand therethrough; and a wrist support portion below the opening.

14. The device of claim 12, further comprising a plurality of nodes protruding from the surface of the hand rest.

15. The device of claim 12, wherein the housing includes a hood portion extending over the hand rest.

16. The device of claim 15, further comprising:

a power source for the pump in the basin; and a cord extending from the power source through a hole provided in the housing, wherein the hole is positioned on the housing to drain treatment fluid from the basin when the basin is overfilled with treatment fluid.

17. The device of claim 12, wherein the hand rest is semi-spherical in shape.

18. The device of claim 17, wherein the housing includes a hand rest support in the form of a raised platform and the hand rest is secured to the hand rest support.

19. The device of claim 12, wherein the hand rest is pivotally secured to the housing.

20. The device of claim 12, wherein the pump includes an outlet moveable relative to the basin to adjust a position of the outlet in the basin relative to a level of treatment fluid in the basin.

21. The device of claim 20, wherein the outlet is pivotally mounted to the pump.

22. A device for treating a hand, comprising:

a housing having a basin for retaining a treatment fluid therein and a hand rest positioned within the housing adjacent the basin, the hand rest having a surface configured for supporting the hand in relation to the basin with at least a portion of the hand submerged in the treatment fluid in the basin;

a pump positioned in the housing, wherein the pump is operable to circulate the treatment fluid in the basin to provide therapy to the submerged portion of the hand with the circulating treatment fluid, wherein the pump includes an outlet submersible in the treatment fluid in the basin, and the pump is operable to continuously circulate treatment fluid in the basin through the submerged outlet to provide therapy to the submerged portion of the hand.

23. The device of claim 22, wherein the surface of the hand rest includes a palm support portion and the housing includes:

an opening having a vertical orientation and sized to receive the hand therethrough; and a wrist support portion below the opening.

24. The device of claim 22, further comprising a plurality of nodes protruding from the surface of the hand rest.

25. The device of claim 22, further comprising a cord extending from a power source through a hole provided in the housing, wherein the hole is positioned on the housing to drain treatment fluid from the basin when the basin is overfilled with treatment fluid.

26. The device of claim 22, wherein the submerged portion of the hand is between the hand rest and the outlet.

27. The device of claim 26, wherein the outlet is positionable at any one of a number of positions corresponding to a level of the treatment fluid in the basin.

28. The device of claim 27, wherein the outlet is pivotally mounted to the pump.

29. The device of claim 22, wherein the hand rest includes a spherically-shaped ball pivotally mounted in the housing.

* * * * *